US008732966B2

(12) United States Patent
Snow

(10) Patent No.: US 8,732,966 B2
(45) Date of Patent: May 27, 2014

(54) SNAP-ON GRIP ATTACHMENT FOR HAIR CLIPPER

(75) Inventor: Gary Lee Snow, Rock Falls, IL (US)

(73) Assignee: Wahl Clipper Corporation, Sterling, IL (US)

( * ) Notice: Subject to any disclaimer, the term of this patent is extended or adjusted under 35 U.S.C. 154(b) by 265 days.

(21) Appl. No.: 13/098,856

(22) Filed: May 2, 2011

(65) Prior Publication Data

US 2012/0279073 A1 Nov. 8, 2012

(51) Int. Cl.
*B26B 19/02* (2006.01)
*B26B 19/38* (2006.01)

(52) U.S. Cl.
USPC ..... 30/537; 30/208; 30/198

(58) Field of Classification Search
CPC ..... B26B 19/00; B26B 19/02; B26B 19/38; B26B 19/3806; B26B 19/3813; B26B 19/382; B26B 19/3826; B26B 19/3853
USPC ..... 30/398, 231, 232, 290, 291, 296.1, 298, 30/194, 208–210, 215–220, 312, 313, 198, 30/537; 16/110.1, 422, 426, 430, 444, 16/446; D28/44–44.1, 45–54
See application file for complete search history.

(56) References Cited

U.S. PATENT DOCUMENTS

| | | | | | |
|---|---|---|---|---|---|
| 328,473 | A | * | 10/1885 | Fitch | 30/456 |
| 1,201,317 | A | * | 10/1916 | Lishawa | 30/74.1 |
| 1,475,444 | A | * | 11/1923 | Mayberry | 30/198 |
| 1,761,550 | A | * | 6/1930 | Wahl | 30/201 |
| 1,987,444 | A | * | 1/1935 | Jeppsson | 30/218 |
| 2,194,707 | A | * | 3/1940 | Locker | 30/2 |
| 2,207,269 | A | * | 7/1940 | Schiff | 30/34.05 |
| D123,072 | S | * | 10/1940 | Bars et al. | D28/73 |
| D137,451 | S | * | 3/1944 | Harstad | D22/118 |
| 2,471,825 | A | * | 5/1949 | Long | 30/541 |
| 2,962,197 | A | * | 11/1960 | Spangler, Jr. | 30/537 |
| 3,372,481 | A | * | 3/1968 | Skinner | 30/210 |
| 3,465,802 | A | * | 9/1969 | Alea | 30/287 |
| 4,120,073 | A | * | 10/1978 | Studebaker | 16/425 |
| 4,127,915 | A | * | 12/1978 | Logan et al. | 16/425 |
| 4,226,418 | A | * | 10/1980 | Balfour | 16/DIG. 12 |
| 4,542,585 | A | * | 9/1985 | Ito et al. | 30/210 |
| D304,867 | S | * | 11/1989 | Okamoto | D28/53 |
| D319,324 | S | * | 8/1991 | Wahl et al. | D28/53 |
| D339,213 | S | * | 9/1993 | Wahl et al. | D28/54 |
| D351,046 | S | * | 9/1994 | McCambridge et al. | D28/53 |
| 5,609,175 | A | * | 3/1997 | Gerry et al. | 135/16 |
| 5,787,587 | A | * | 8/1998 | Wahl et al. | 30/210 |
| 6,079,758 | A | * | 6/2000 | Romero et al. | 294/25 |

(Continued)

FOREIGN PATENT DOCUMENTS

| | | | |
|---|---|---|---|
| CH | 230763 | A * | 1/1944 |
| CH | 233423 | A * | 7/1944 |

(Continued)

*Primary Examiner* — Jason Daniel Prone
(74) *Attorney, Agent, or Firm* — Greer, Burns & Crain, Ltd.

(57) ABSTRACT

A hair clipper grip attachment is provided that is configured for releasably engaging a hair clipper, and includes a body with an exterior surface, an interior surface configured for contacting an exterior of a housing of the clipper. The body is constructed and arranged for releasably engaging the hair clipper in a snap-clip fashion for providing a thermally insulating layer that protects a user's hand from heat generated by the hair clipper.

17 Claims, 3 Drawing Sheets

(56) References Cited

U.S. PATENT DOCUMENTS

| | | | | | |
|---|---|---|---|---|---|
| 6,112,414 | A * | 9/2000 | Andis et al. | 30/231 |
| D435,935 | S * | 1/2001 | Nobile et al. | D28/48 |
| 6,267,117 | B1 * | 7/2001 | Bisson | 132/200 |
| 6,604,287 | B2 * | 8/2003 | Melton et al. | 30/123 |
| 7,070,351 | B2 * | 7/2006 | Cooper et al. | 16/430 |
| 7,073,262 | B2 * | 7/2006 | Melton | 30/233.5 |
| 7,398,579 | B2 * | 7/2008 | Moshenrose | 16/430 |
| D577,865 | S * | 9/2008 | Long et al. | D28/54 |
| 7,480,964 | B2 * | 1/2009 | Vidal | 16/DIG. 12 |
| D651,346 | S * | 12/2011 | Snow et al. | D28/54 |
| D673,371 | S * | 1/2013 | Sheikh | D3/318 |
| D679,447 | S * | 4/2013 | Colle | D28/53 |
| 2003/0024543 | A1 * | 2/2003 | Wolf | 16/430 |
| 2005/0015997 | A1 * | 1/2005 | Roble | 30/232 |
| 2010/0287736 | A1 * | 11/2010 | Ameduri | 16/430 |
| 2013/0061428 | A1 * | 3/2013 | Freuler | 16/400 |

FOREIGN PATENT DOCUMENTS

| | | | |
|---|---|---|---|
| CH | 255513 | A * | 6/1948 |
| DE | 3320290 | A1 * | 12/1984 |
| FR | 959157 | A * | 3/1950 |

* cited by examiner

SNAP-ON GRIP ATTACHMENT FOR HAIR CLIPPER

BACKGROUND

The present invention relates to powered hair cutting devices, particularly hair clippers and hair trimmers, and more specifically to a grip enhancing attachment for such devices.

Hair care professionals such as barbers and hair stylists frequently use powered hair clippers and trimmers (hereafter collectively referred to as "clippers") in the course of styling customers' hair. When work becomes busy, for example when several haircuts are performed in quick succession, or when a particular customer's hair is long, the professional often grasps the running clipper for extended periods of time. In the course of such use, the clipper housing often becomes hot to the touch, causing discomfort to the professional. Also, under such conditions, the professional's hands often become sweaty and prevent a solid grip on the clipper, which may cause the clipper to be dropped.

Many hair care professionals address this problem by merely enduring the hot temperatures, which makes work unpleasant and may cause unsatisfactory work product. Some adjust their grip on the clipper housing in an attempt to avoid the hotter locations of the housing. Others exchange the hot clipper for a fresh one, which increases the required capital investment of the professional, and which may result in unsatisfactory work product due to inconsistent performance characteristics of a particular clipper. Another problem often encountered with conventional hair clippers is that the clipper is wrenched from the professional's hands due to the professional or a colleague inadvertently stepping on the clipper power cord.

SUMMARY

The present hair clipper grip attachment addresses the above-identified problem by providing a removable grip attachment featuring an additional layer of insulating material between the hair care professional's hand and portions of the hot clipper housing. Fastening the present attachment upon a clipper housing is easily accomplished without the use of tools. Further, the present attachment provides a trigger guard-style formation that enables the professional to securely hold the clipper while reducing skin contact with the housing, or alternately to hang the clipper from a finger while working with scissors and comb and thus avoid the hot clipper housing. Use of the present attachment prolongs the required switch by the professional to a second, fresh clipper, and thus is more efficient. In addition, the present clipper attachment prevents the clipper from being wrenched from the professional's hands when the power cord is inadvertently stepped on.

More specifically, a hair clipper grip attachment is provided that is configured for releasably engaging a hair clipper, and includes a body with an exterior surface, an interior surface configured for contacting an exterior of a housing of the clipper. The body is constructed and arranged for releasably engaging the hair clipper in a snap-clip fashion for providing a thermally insulating layer that protects a user's hand from heat generated by the hair clipper.

In another embodiment, a hair clipper grip attachment is provided that is configured for releasably engaging a hair clipper, wherein the clipper includes a bladeset defining at least one slot, and a housing provided with mounting fastener throughbores. The attachment includes a body with an exterior surface having a generally outwardly projecting finger guard, an interior surface configured for contacting an exterior of the clipper housing, a first side, and an opposite second side. Each of the first and second sides are dimensioned to overhang corresponding underside corners of the clipper housing, and the second side includes a portion extending farther from the finger guard than the first side and having at least one lug constructed and engaged for releasably engaging one of the mounting fastener throughbores. At least one tongue formation is provided on the body, configured for releasably engaging one of the slots. The body is constructed and arranged for releasably engaging the hair clipper in a snap-clip fashion such that the finger guard projects from an underside of the clipper.

In still another embodiment, a combination hair clipper and grip attachment is provided, including a hair clipper having a housing with an underside, a pair of opposed sides, a bladeset at a first end defining at least one slot and an opposite second end and at least one mounting fastener throughbore in one of the sides. An attachment body has an exterior surface with a generally normally projecting finger guard, an interior surface configured for contacting an exterior of a housing of the clipper, a first side, and opposite second side, a front end provided with at least one tongue formation and a rear end. The body is constructed and arranged for releasably engaging the hair clipper in a snap-clip fashion such that the finger guard projects from an underside of the clipper. The body is releasably clampable upon the clipper without the use of tools and solely by engagement of the at least one tongue in the corresponding slot, the at least one lug in the corresponding mounting throughbore, and the overhang of the first and second sides over corresponding sides of the housing.

DETAILED DESCRIPTION

Figure 1:
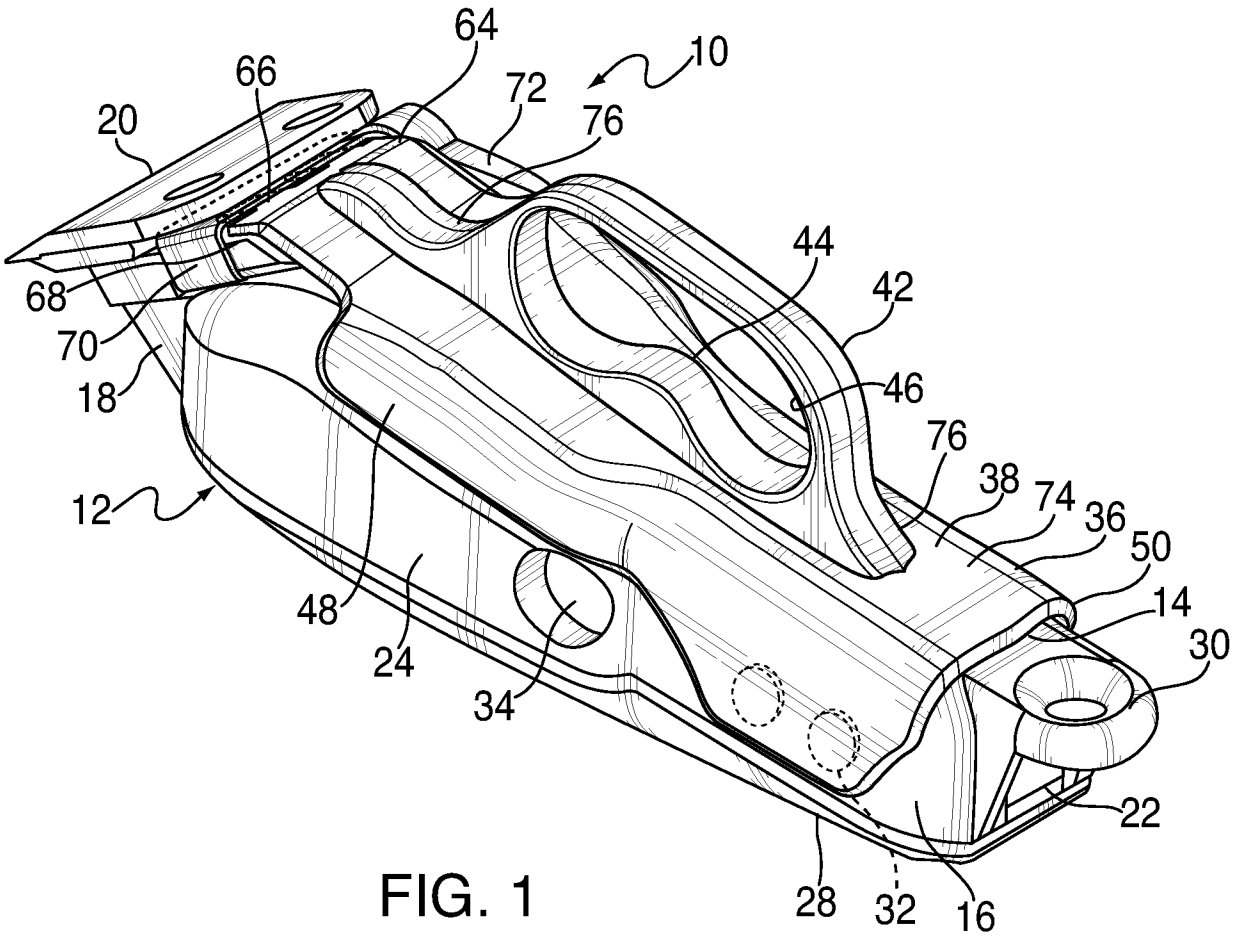
FIG. 1 is a top perspective view of the present clipper grip attachment shown mounted on the underside of a hair clipper.
Figure 2:
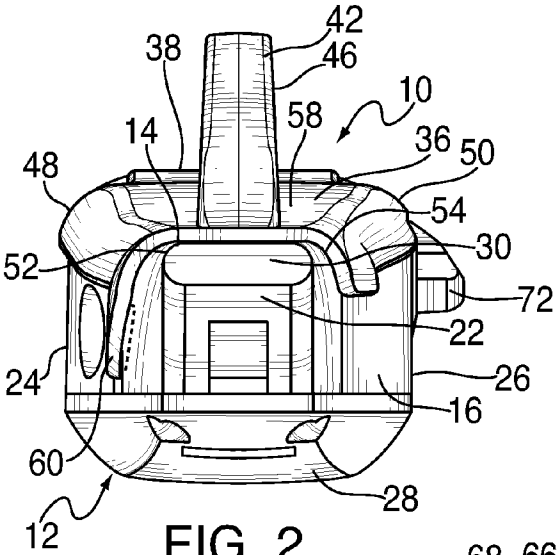
FIG. 2 is a rear end elevation of the attachment and clipper of FIG. 1.
Figure 3:
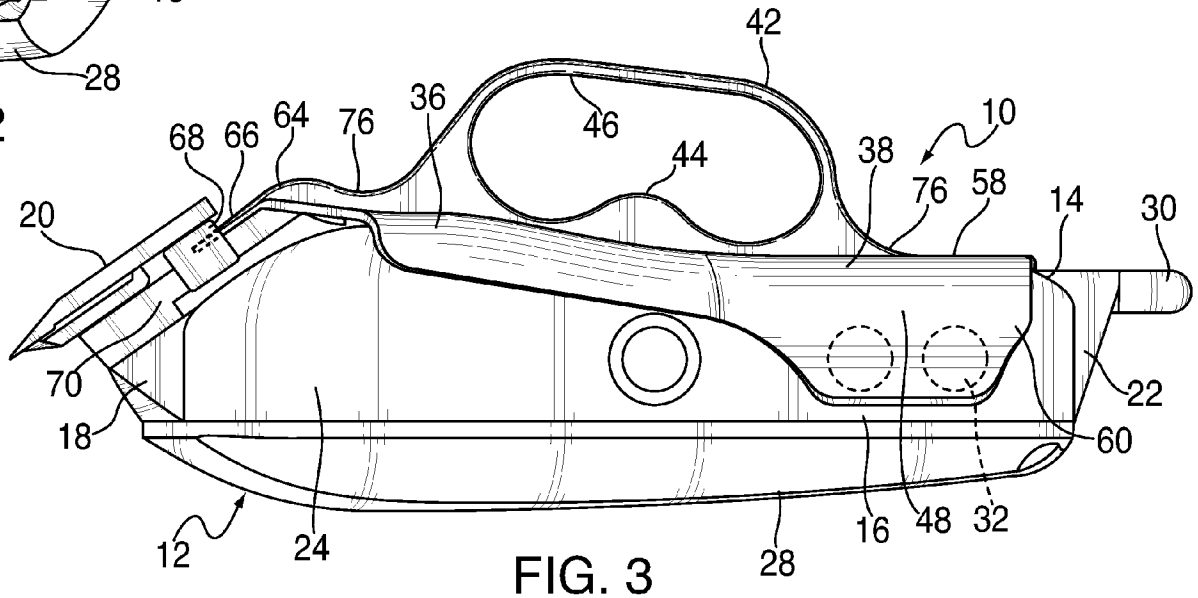
FIG. 3 is a left side elevation of the attachment and clipper of FIG. 1.

Referring now to FIGS. 1-3, the present hair clipper grip attachment is generally designated 10 and is shown mounted to a hair clipper, generally designated 12 and depicted in an inverted position, with an underside 14 shown facing upward. The hair clipper 12 has a housing 16 with a front end 18 provided with a bladeset 20, and an opposite rear end 22. Other portions of the clipper housing 16 include a housing first side 24, a housing second side 26 and a housing top 28. As is known in the art, the rear end 22 is fitted with a hanging eyelet 30, and the housing first side 24 has a pair of mounting throughbores 32 (shown hidden) which are covered when the housing is assembled, but during clipper assembly, are used to assemble internal motor components (not shown). An adjustment screw opening 34 is also preferably located on the housing first side 24 adjacent the mounting throughbores 32. The housing top 28 includes a depending tab (not shown) which internally blocks the mounting throughbores 32 upon clipper assembly.

Referring now to FIGS. 1-6, the grip attachment 10 is configured for releasable attachment to the clipper housing 16 without the use of tools and is intended to provide the user with a layer of thermally insulating material. This thermal insulation is desirable so that the hair care professional can work longer in greater comfort despite the higher clipper housing temperatures inherent with long-term clipper operation. Upon installation of the grip attachment 10 to the clipper housing 16, the user's hands grip the attachment rather than the housing 16 and are thus protected from high housing temperatures. It has been found that the temperature of the attachment 10 when mounted on a hot, running clipper is approximately 15% cooler to the touch compared to a conventional clipper.

Included on the grip attachment 10 is a body 36 with an exterior surface 38, an interior surface 40 (FIGS. 4-6) configured for contacting an exterior of the clipper housing 16, and is constructed and arranged for releasably engaging the hair clipper 12 in a snap-clip fashion for providing the above-described thermally insulating layer that protects a user's hand from heat generated by the hair clipper.

Figure 5:
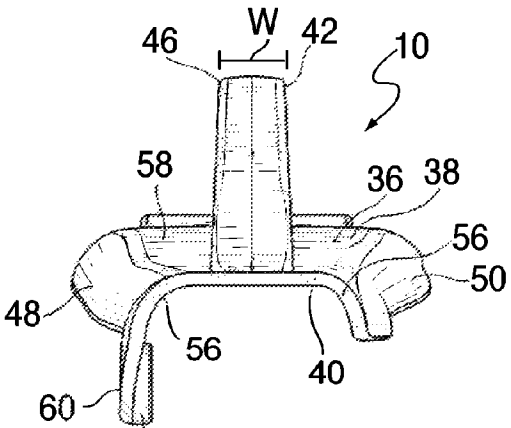
FIG. 5 is a rear elevation of the attachment of FIG. 4.

Also featured on the grip attachment 10 is an outwardly projecting, looped finger guard 42 constructed and arranged so that upon engagement of the attachment on the clipper 12, the finger guard generally projects from the clipper underside 14, and specifically from the exterior surface 38 of the attachment 10. While other orientations are contemplated, the finger guard projects generally normally from the exterior 38 of the attachment body 36. Preferably included with the finger guard 42 is a finger separating portion 44 encircled by a loop portion 46. The finger separating formation 44 extends normally from the body exterior surface 38 and has a width generally corresponding to a width 'W' of the loop portion 46 (FIG. 5). It is preferred that the width 'W' is sufficient for supporting the clipper in an upright position (opposite that shown in FIG. 1), with the loop portion 46 and the bladeset 20 resting on a substrate, such as a table. While the dimensions of the width 'W" may vary to suit the application, it is preferred that the width be in the range of ¼ to ½ inch, more preferably in the range of ⅜ inch.

To assist the clamping engagement of the attachment 10 on the clipper housing 16, each of first and second sides 48, 50 of the body 36 are dimensioned to overhang corresponding underside corners 52, 54 (FIG. 2) of the clipper housing. It will be seen that the first and second body sides 48, 50 define radiused corners 56 (FIG. 6) with an outer surface 58 of the body exterior 38. Also, the first body side 48 includes a portion 60 extending farther from the finger guard 42 than the second side 50. The second side portion 60 includes at least one and preferably a pair of inwardly projecting, generally circular or ring-shaped lugs 62 (FIGS. 4-6) constructed and arranged for engaging one of the respective mounting fastener throughbores 32 on the clipper housing 16. As described in further detail below, these lugs 62 cooperate with other features on the attachment 10 for securing the attachment to the hair clipper 12.

Figure 4:
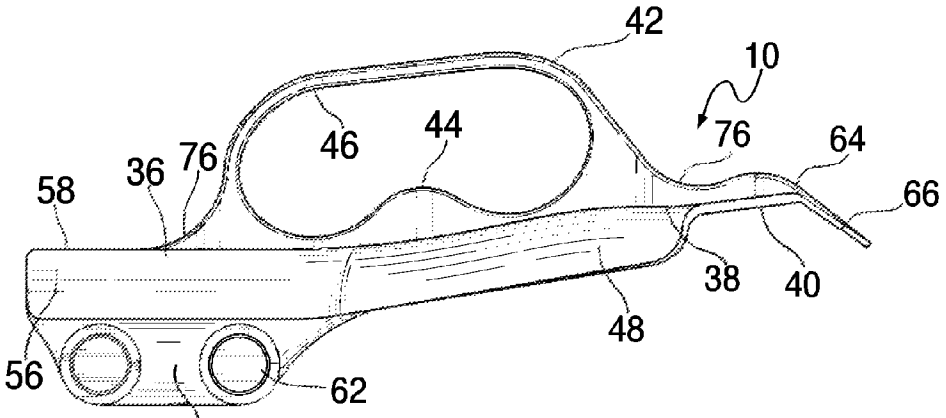
FIG. 4 is a right side elevation of the attachment of FIG. 1.
Figure 6:
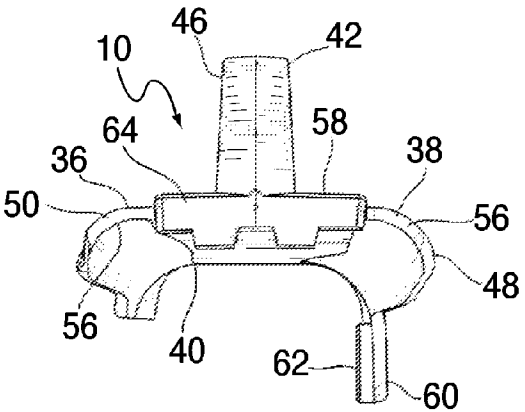
FIG. 6 is a front elevation of the attachment of FIG. 4.

Referring now to FIGS. 1, 3 and 4, a front end 64 of the attachment body 36 is provided with at least one and preferably two forwardly projecting, generally planar tongues or tongue formations 66. The tongues 66 are constructed and arranged for each releasably and slidably engaging a respective slot 68 defined between the bladeset 20 and the clipper housing 16. More particularly, the slot 68 is defined by a movable bracket 70 connected to an adjustment lever 72 which adjusts the relative position of the fixed and moving blades of the bladeset 20 as is known in the art. Thus, the attachment body 36 is releasably clampable upon the clipper 12 solely by engagement of the at least one tongue formation 66 in the corresponding slot 68, the at least one lug 62 in the corresponding mounting throughbore 32, and the overhang of the first and second sides 48, 50 over the corresponding sides 24, 26 of the housing 16. No tools or supplemental fasteners are needed to secure the attachment 10 to the clipper 12. Some stylists are able to clamp the attachment 10 upon a clipper 12 using a one-handed motion. It should be noted that most of the gripping action provided by the overhang of the first and second sides 48, 50 is exerted in to a region 74 (FIG. 1) adjacent to the first side portion 60.

Using the present attachment 10, the hair care professional grips the clipper 12 by holding the attachment exterior surface 38. As such, the user's hand is insulated from the clipper body 16 as it heats up during prolonged operation. If desired, the user can also hold the clipper by the finger guard 42, hooking a finger in the loop portion 46 while the remaining fingers of that hand are used to hold a comb and/or a scissors as desired. It has also been found that radiused ends 76 of the loop portion 46 facilitate manipulation by the user. It has been found that the finger guard 42 provides the user with an enhanced grip with less chance of dropping the clipper 12 for a variety of reasons, including sweaty hands, the power cord being stepped on, or other causes generally known to hair care professionals. In addition, with the attachment 10 secured to the clipper 12, the clipper is operable with reduced hand grip pressure, such that the attachment provides ergonomic benefits to the user.

While particular embodiments of the present snap on grip attachment for a hair clipper has been shown and described, it will be appreciated by those skilled in the art that changes and modifications may be made thereto without departing from the invention in its broader aspects and as set forth in the following claims.

What is claimed:

1. A combination hair clipper and grip attachment, comprising:

a hair clipper having a housing, a pair of opposed sides, a bladeset at a first end defining at least one slot and an opposite second end and at least one mounting fastener throughbore in one of said sides, wherein said bladeset consists of a pair of blades;

a grip attachment including a body with an exterior surface having a generally normally projecting finger guard, an interior surface configured for contacting an exterior of the housing of the clipper, a first side, an opposite second side, a front end provided with at least one tongue formation and a rear end, wherein said at least one tongue formation extends in a plane generally parallel to a plane defined between said blades of the bladeset;

said body constructed and arranged for releasably engaging said hair clipper in a snap-clip fashion such that said finger guard projects outwardly from the clipper; and without the use of tools or supplemental fasteners and solely by engagement of said at least one tongue formation in a corresponding slot defined between said blades of the bladeset, at least one lug in the at least one mounting throughbore, and overhangs of said first and second sides over corresponding sides of the housing of the clipper.

2. The combination hair clipper and grip attachment of claim 1 wherein said finger guard cooperates with the clipper bladeset in supporting the clipper on a flat surface such that an end of the clipper opposite of an end with the bladeset is not in contact with the flat surface.

3. The combination hair clipper and grip attachment of claim 1, wherein said first side extends in a first direction beyond said finger guard and said second side extends in a second direction beyond said finger guard, wherein said first direction is opposite of said second direction, and further wherein said first side and said second side are asymmetrical with respect to an imaginary line that extends longitudinally through said finger guard.

4. The combination hair clipper and grip attachment of claim 1, wherein:

said finger guard includes a loop and a finger separating formation; and said separating formation extends normally from said exterior surface and has a width generally corresponding to a width of said loop.

5. A hair clipper grip attachment configured for releasably engaging a hair clipper, wherein the clipper includes a bladeset defining at least one slot, and a housing provided with mounting fastener throughbores, said attachment comprising:

a body with an exterior surface, and an interior surface configured for contacting an exterior of a housing of the clipper during the releasable engagement with the clipper;

an outwardly projecting finger guard projecting from the exterior surface of the body; and said body being constructed and arranged such that the releasable engagement with the clipper is performed in a snap-clip fashion, thereby defining a thermally insulating layer that protects a user's hand from heat generated by the hair clipper, wherein said body includes a first body side that extends in a first direction beyond said finger guard and a second body side that extends in a second direction beyond said finger guard, wherein said first direction is opposite of said second direction, and further wherein said first body side and said second body side are asymmetrical with respect to an imaginary line that extends longitudinally through said finger guard, wherein said first and second directions are transverse to said imaginary line, and wherein said body is constructed and arranged such that the releasable engagement with the clipper housing is performed without the use of tools.

6. The grip attachment of claim 5 wherein said finger guard is constructed and arranged so that upon the releasable engagement of said attachment upon the clipper, said finger guard generally projects outwardly from the clipper.

7. The grip attachment of claim 5 wherein said finger guard projects generally normally from said body.

8. The grip attachment of claim 5 wherein each of said first and second body sides overhang corresponding corners of the clipper housing, and said first body side includes a portion extending farther from said finger guard than said second body side.

9. The grip attachment of claim 8, wherein said first and second sides define radiused corners with a planar surface of said exterior surface of said body.

10. The grip attachment of claim 8 wherein said first side portion includes at least one inwardly projecting lug for engaging one of the mounting fastener throughbores on the clipper housing during the engagement with the clipper.

11. The grip attachment of claim 1 wherein a front end of said body is provided with at least one generally planar tongue formation constructed and arranged for releasably engaging the at least one slot during the engagement with the clipper.

12. The grip attachment of claim 1 wherein said body is provided with at least one tongue formation for releasably engaging the at least one slot during the engagement with the clipper, and at least one lug for releasably engaging one of the fastener throughbores during the engagement with the clipper.

13. The grip attachment of claim 12 wherein said releasable engagement of said body upon the clipper occurs solely by engagement of said at least one tongue in the corresponding slot, said at least one lug in the corresponding mounting throughbore, and overhangs of said first and second body sides over corresponding sides of the housing.

14. The grip attachment of claim 5 wherein said finger guard includes a loop and a finger separating formation.

15. The grip attachment of claim 14 wherein said separating formation extends normally from said exterior surface and has a width generally corresponding to a width of said loop.

16. A hair clipper grip attachment configured for releasably engaging a hair clipper, wherein the clipper includes a bladeset defining at least one slot, and a housing provided with mounting fastener throughbores, said attachment comprising:

a body with an exterior surface having a generally outwardly projecting finger guard, an interior surface configured for contacting an exterior of the clipper housing during the releasable engagement with the clipper, a first side, and an opposite second side;

each of said first and second sides are dimensioned to overhang corresponding corners of the clipper housing, and said first side includes a portion extending farther from said finger guard than said second side and having at least one lug constructed and engaged for releasably engaging one of the mounting fastener throughbores;

said body is provided with at least one tongue formation configured for releasably engaging one of the slots during the releasable engagement with the clipper; and said body being constructed and arranged such that the releasable engagement with said hair clipper is performed in a snap-clip fashion, such that said finger guard generally projects from the clipper, wherein said first side extends in a first direction beyond said finger guard and said second side extends in a second direction beyond said finger guard, wherein said first direction is opposite of said second direction, and further wherein said first side and said second side are asymmetrical with respect to an imaginary line that extends longitudinally through said finger guard, wherein said first and second directions are transverse to said imaginary line.

17. The hair clipper grip attachment of claim 16, wherein:

said finger guard projects generally normally from said body and is constructed and arranged so that upon the engagement of said attachment upon the clipper, said finger guard generally projects outwardly from the clipper; and a front end of said body is provided with the at least one tongue formation.

* * * * *